US005155713A

United States Patent [19]

Addor et al.

[11] Patent Number: 5,155,713

[45] Date of Patent: Oct. 13, 1992

[54] WATCH CASE

[75] Inventors: René Addor, La Rippe; Alberto Jaussi, Petit-Lancy, both of Switzerland

[73] Assignee: Montres Rolex S.A., Switzerland

[21] Appl. No.: 664,606

[22] Filed: Mar. 4, 1991

[30] Foreign Application Priority Data

Mar. 6, 1990 [CH] Switzerland ..... 0704/90

[51] Int. Cl.[5] ..... G04B 37/00

[52] U.S. Cl. ..... 368/285; 368/294

[58] Field of Search ..... 368/88, 276, 281-282, 368/285, 294-296

[56] References Cited

U.S. PATENT DOCUMENTS

| | | | |
|---|---|---|---|
| 3,039,263 | 6/1962 | Wyler | 368/282 |
| 4,473,306 | 9/1984 | Lederrey | 368/296 |
| 4,525,077 | 6/1985 | Ketner | 368/77 |

FOREIGN PATENT DOCUMENTS

| | | |
|---|---|---|
| 168010 | 1/1986 | European Pat. Off. . |
| 1327590 | 4/1963 | France . |
| 337465 | 5/1959 | Switzerland . |
| 355094 | 7/1961 | Switzerland . |
| 654973G | 3/1986 | Switzerland . |
| 654973 | 9/1986 | Switzerland . |
| 671493 | 9/1989 | Switzerland . |
| 933969 | 8/1963 | United Kingdom . |

*Primary Examiner*—Vit W. Miska

[57] ABSTRACT

The portion of the rim (1) situated between the flanges (2) presents a clearance (3) in the form of an arc of a circle provided between the lateral exterior side and concentric with the center of the case. Another clearance (4), also in the form of an arc of a circle, is provided in the surface of the rim (1) adjacent to the crystal (5) and extends at an angle from the first clearance (3) and on both sides thereof. The edge of the second clearance (4) is located at a distance from the outside edge of the rim (1), thus providing two retaining eyes (4*a*). The clearances (3, 4) receive a decorative element (6), the upper side of which is adjacent to the lower side of the crystal (5), which prevents it from falling out through the clearance (4).

10 Claims, 4 Drawing Sheets

WATCH CASE

FIELD OF THE INVENTION

The invention relates to a watch case with an inlaid decorative element.

BACKGROUND OF THE INVENTION

In general, there is play between the main body and the watch band for fixing the watch band to the case of the wrist watch. This play creates a separation between the watch and the watch band, which makes it clear that these are two distinct elements visibly attached to each other. For some time solutions have been proposed which allow making the attachment of the watch band to the watch invisible, for example by providing a groove in the main body for concealing this attachment.

In Swiss CH 649 675 it has also been proposed to attach two pins to the main body for hiding the flanges, the pins having eyes, which are traversed by a threaded hole, being introduced into receptacles in the main body and retained by fastening screws. These pins are also used for fastening the bezel to the main body. This solution is particularly suitable for a rectangular watch. Although in such a watch the fastening screws can be provided in the corners of the case, this is not so with a round watch, so that this solution cannot be adapted to that type of watch.

In the case of round watches it has been proposed in connection with watch bands made of articulated metal links to design the end links, which are next to the case, in a form which is exactly complementary to the space delimited by the flanges and the main body, and to provide a passage across each one of these links for the fastening pin of the watch band to the case in such a way that, once fixed in the flanges, the link is for all practical purposes of one piece with the case and appears to be perfectly integrated with the latter. Such a solution is illustrated in particular in Swiss CH 483 214, but is not applicable in this shape except for a watch band with metal links and not for a watch band made of leather, for example.

SUMMARY OF THE INVENTION

The aim of the present invention is to allow the fastening of a decorative element to the case of a watch, particularly an element which is apt to conceal the attachment of the watch band to the case of a wrist watch.

It is therefore the object of this invention to disclose a watch case with an inlaid, decorative element.

The essential advantage of the proposed solution is found in its simplicity, because the inlaid decorative element does not require any particular attachment piece, but is retained in the main body either by the bezel or by the bottom. In comparison with solutions where a clearance is provided in the main body for hiding the attachment of the watch band, the present invention in particular allows to give the surface an appearance of a decor inlaid in this manner, which is different from that of the top and interior surfaces of the flanges, and to provide different levels between the surface of the flanges and that of the decorative element.

The attached drawings illustrate schematically and by way of example different variants of the watch case in accordance with the present invention.

DETAILED DESCRIPTION OF THE PREFERRED EMBODIMENTS

Figure 1:
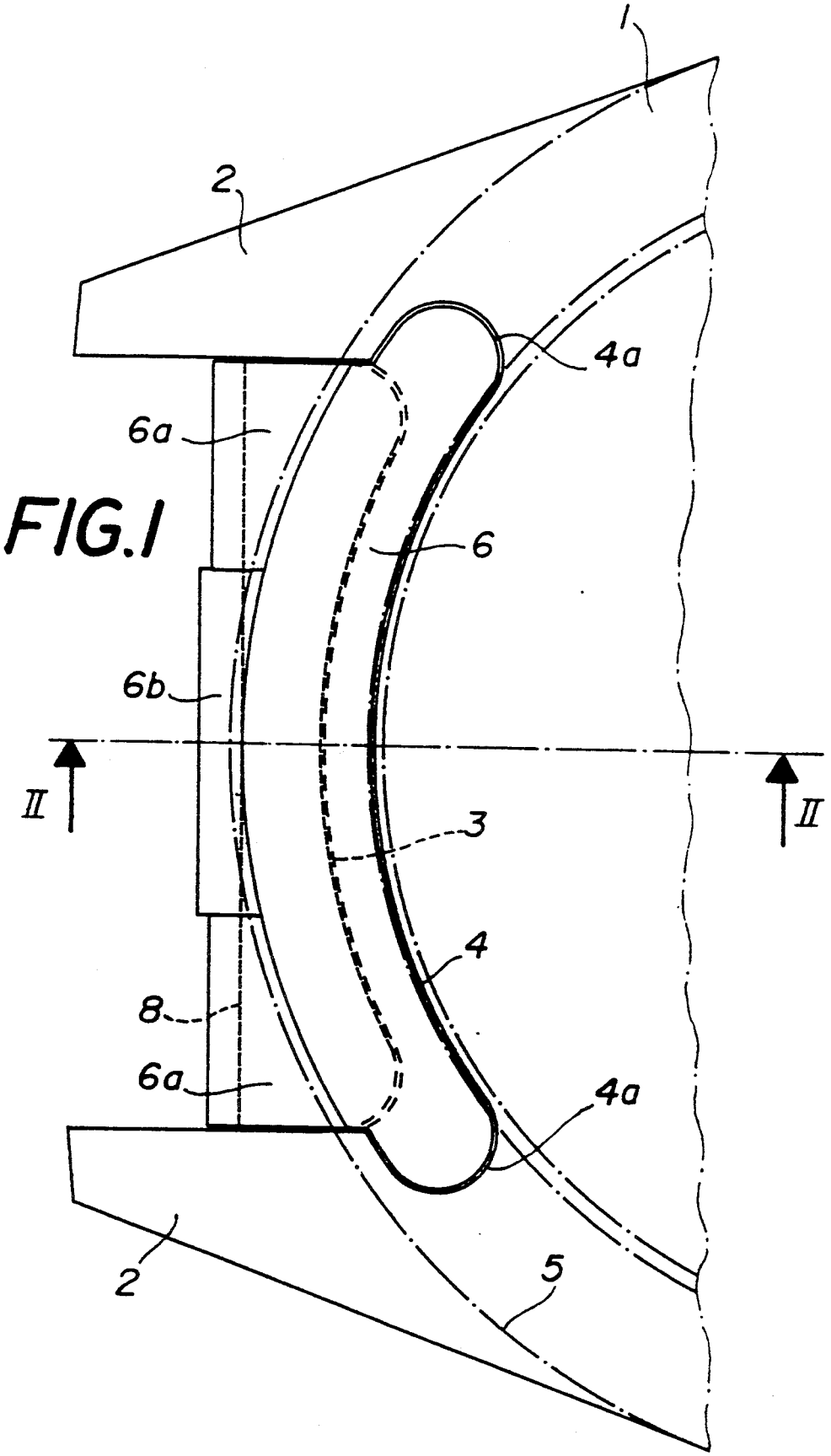
FIG. 1 is a partial top view of a watch case in accordance with a first variant.
Figure 2:
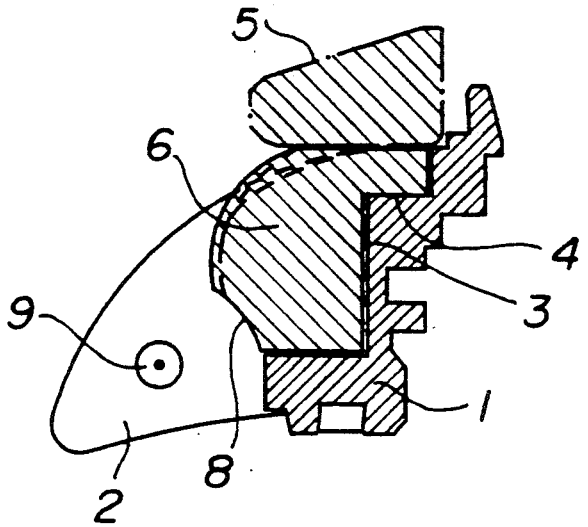
FIG. 2 is a sectional view along the line II—II of FIG. 1.

FIGS. 1 and 2 show a case of a writs watch in which the portion of the main body 1 situated between the flanges 2 presents a clearance 3 in the form of an arc of a circle provided between the lateral exterior side and concentric with the center of the case. Another clearance 4, also in the form of an arc of a circle, is provided in the surface of the main body 1 adjacent to the crystal 5. As can be seen in FIG. 1, the clearance 4 extends at an angle from the first clearance 3 and on both sides thereof. However, the edge of the second clearance 4 is located at a distance from the outside edge of the main body 1, thus providing two retaining eyes **4*a* at the ends of the clearance 4**.

The clearances 3 and 4 receive a decorative element 6, the surface of which next to the main body 1 is complementary to that of the clearances 3 and 4. As shown in FIG. 2, the upper surface of the decorative element 6 is adjacent to the lower side of the bezel 5, which in this way prevents it from falling out through the second clearance 4 and the retaining eyes **4*a*. FIG. 2 also shows that the decorative element, which extends towards the outside of the main body through the space the located between the flanges 2, has a clearance 8 constituted by a portion of the cylindrical surface centered on the axis of the fastening pin 9 of the watch band (not shown). In this way the clearance 8 allows passage for the end of the watch band, without there being a space visible from the top of the case between the latter and the watch band. FIGS. 1 and 2 show that the decorative surface of the element 6 may have different levels. It can be particularly seen that the two decorative surfaces 6*a* adjacent to the flanges 2 are at a level much lower than that of the central surface 6*b*, in the same way as that of the upper surface of the flanges. Because of this it is possible to give the decorative surfaces a finish different from that of the flanges. Therefore if, for example, the flanges 2 are polished, the surfaces 6*a* may be matte and the surface 6*b* polished. It is again emphasized that in order, not to interfere with the fastening of the bezel 5 on the main body 1, the thickness of the portion of the decorative element 6 lodged in the second clearance 4** is less by some hundredths of a millimeter than the depth of this clearance.

Figure 4:
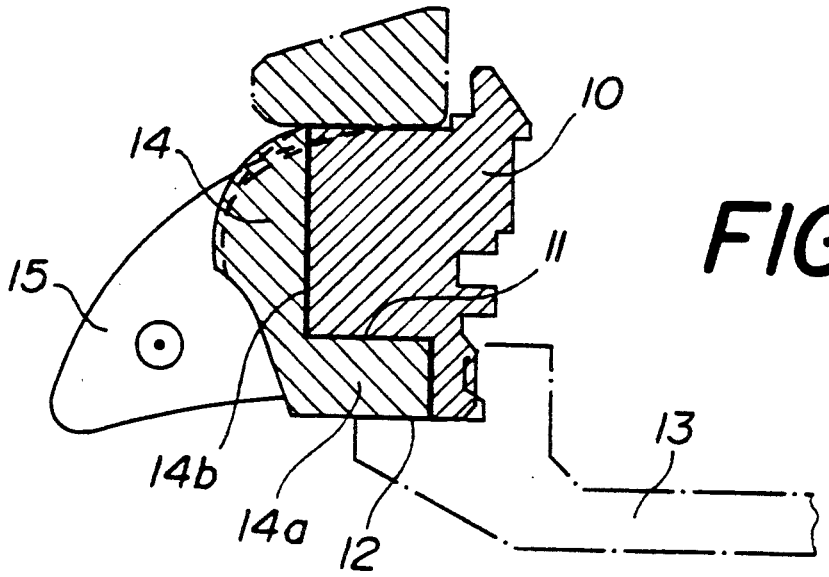
FIG. 4 is a sectional view along the line IV—IV of FIG. 3.
Figure 3:
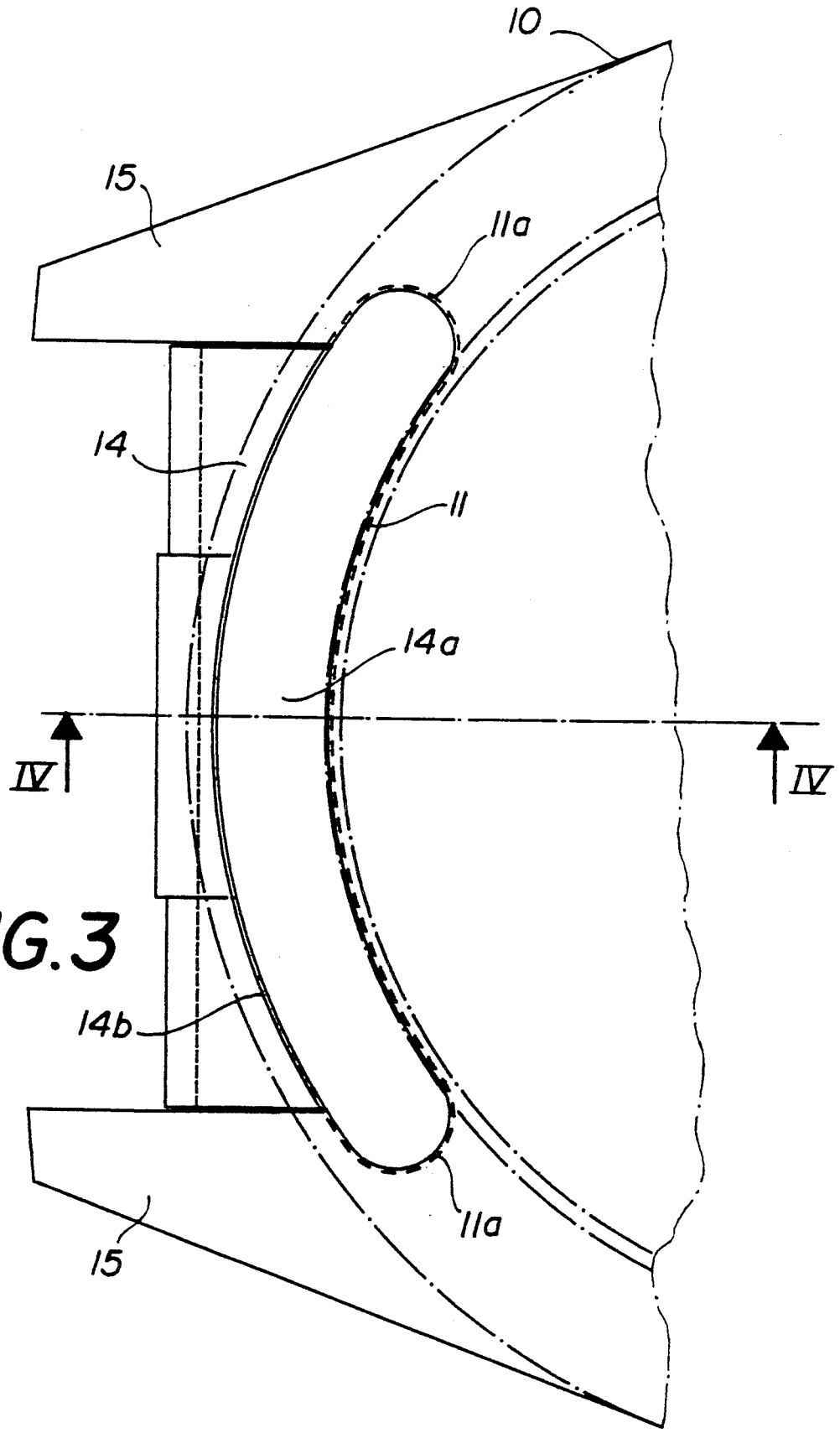
FIG. 3 is a partial top view of a watch case in accordance with a second variant.

In the variant illustrated by FIGS. 3 and 4, the main body 10 has a clearance 11 provided in its lower side adjacent to the side of the abutment 12 of the bottom 13. The outer edge of the median part of this clearance 11, located between the flanges 15, opens in the direction of the outer side of the rim which, in this case, does not have any clearance, whereas the ends **11*a* of the clearance 11 are encompassed by a shoulder. The decorative element 14 comprises a part 14*a* complementary to the clearance 11, used to retain the decorative element once the bottom 13 is fixed on the main body and a surface 14***b*, in the form of an arc of a circle, adjacent to the portion of the lateral outer side of the main body located between the flanges 15. As shown in FIG. 3, the visible decorative surface of the decorative element 14 has an appearance which may be identical to that of FIG. 1.

Figure 5:
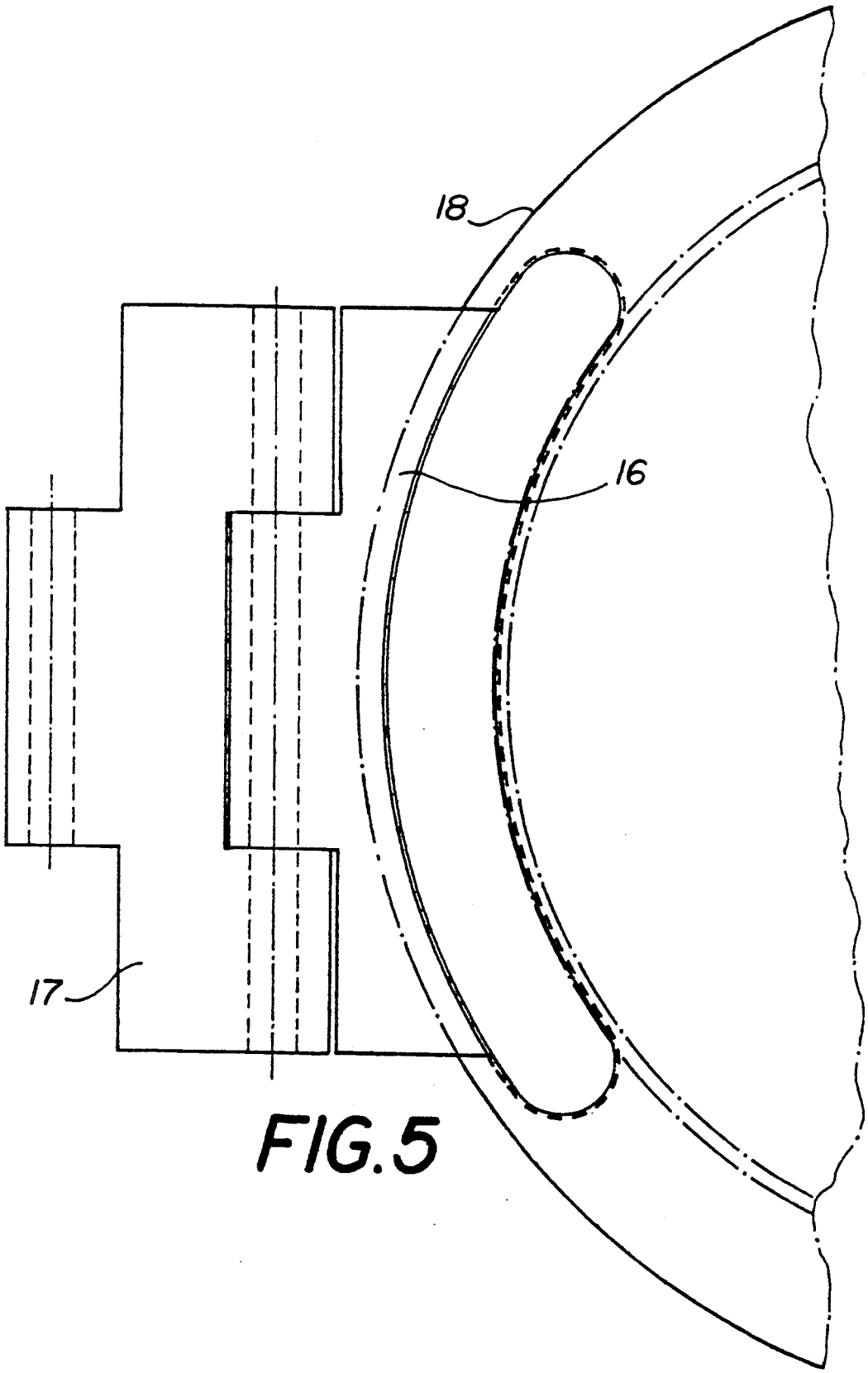
FIG. 5 is a partial top view of a watch case in accordance with a third variant.

In connection with the third variant illustrated in FIG. 5, which in other respects is identical to the preceding variant, the decorative element 16 also constitutes the last link of a link watch band 17 and, at the same time, serves as fastening element for this watch band on the case 18 which in this case may not have flanges, as shown in this drawing figure.

What is claimed is:

1. A watch case comprising a main body (1), a bezel (5), and a bottom (13), said main body having an upper abutment face for the bezel and a lower abutment face for the bottom, said upper abutment face having an elongated clearance (4) extending inwardly of the main body to an inside peripheral edge of the bezel (5), said clearance (4) comprising a median area and two adjacent end areas (4*a*), said median area having an outer peripheral edge adjacent to a lateral outside face of said main body (1), whereas said end areas (4*a*) are each provided with an outer peripheral rim spaced from said lateral outer face;

a decorative element, provided with complimentary portions to said areas to said clearance being fitted into said clearance, faces of the bezel overlapping the clearance and defining abutments for holding said decorative element in said clearance.

2. A watch case in accordance with claim 1, wherein said main body has a second clearance (3) on said lateral outside face which communicates with the outer edge of the median part of the first clearance.

3. A watch case in according with claim 1, further comprising first and second flanges extending from said main body and wherein said decorative element extends between said flanges.

4. A watch case in accordance with claim 2, further comprising first and second flanges extending from said main body, a watchband and a fastening pin for fastening the watchband to said flanges, wherein a cut-out (8) is provided below a decorative side of said decorative element, parallel to an axis of said fastening pin, for the passage of an end of the watchband enclosing said pin.

5. A watch case in accordance with claim 1, wherein said decorative element defines a fastening element for fastening a watchband to said main body.

6. A watch case comprising a main body (10), a bezel (5), and a bottom (13), said main body having an upper abutment face for the bezel and a lower abutment face for the bottom, said lower abutment face having an elongated clearance (11) extending inwardly of the main body to an inside peripheral edge of the bottom (13), said clearance (11) comprising a median area and two adjacent end areas (11*a*), said median area having an outer peripheral edge adjacent to a lateral outside face of said main body (10), whereas said end areas (11*a*) are each provided with an outer peripheral rim spaced from said lateral outer face;

a decorative element, provided with complimentary portions to said areas of said clearance being fitted into said clearance, faces of the bottom overlapping the clearance and defining abutments for holding said decorative element in said clearance.

7. A watch case in accordance with claim 6, wherein said main body has a second clearance on said lateral outside face which communicates with the outer edge of the median part of the first clearance.

8. A watch case in accordance with claim 6, further comprising first and second flanges extending from said main body and wherein said decorative element extends between said flanges.

9. A watch case in accordance with claim 7, further comprising first and second flanges extending from said main body, a watchband and a fastening pin for fastening the watchband to said flanges, wherein a cut-out is provided below a decorative side of said decorative element, parallel to an axis of said fastening pin, for the passage of an end of the watchband enclosing said pin.

10. A watch case in accordance with claim 6, wherein said decorative element defines a fastening element for fastening a watchband to said main body.

* * * * *